US012733785B2

(12) United States Patent
Li et al.

(10) Patent No.: US 12,733,785 B2
(45) Date of Patent: Sep. 15, 2026

(54) ANTI-TANGLE ROLLER BRUSH, ROLLER BRUSH MECHANISM AND SWEEPING ROBOT

(71) Applicants: ZHONGSHAN UNION OPTECH RESEARCH INSTITUTE CO., LTD., Zhongshan (CN); Linksmart Technology (Zhongshan) Co., Ltd., Zhongshan (CN)

(72) Inventors: Maolin Li, Zhongshan (CN); Wenguo Chen, Zhongshan (CN)

(73) Assignees: ZHONGSHAN UNION OPTECH RESEARCH INSTITUTE CO., LTD., Zhongshan (CN); Linksmart Technology (Zhongshan) Co., Ltd., Zhongshan (CN)

( * ) Notice: Subject to any disclaimer, the term of this patent is extended or adjusted under 35 U.S.C. 154(b) by 356 days.

(21) Appl. No.: 18/400,420

(22) Filed: Dec. 29, 2023

(65) Prior Publication Data

US 2025/0127364 A1 Apr. 24, 2025

Related U.S. Application Data

(63) Continuation of application No. PCT/CN2023/136768, filed on Dec. 6, 2023.

(30) Foreign Application Priority Data

Oct. 24, 2023 (CN) ..... 202311391852.3

(51) Int. Cl.
*A47L 11/40* (2006.01)
*A46B 13/00* (2006.01)
(Continued)

(52) U.S. Cl.
CPC ..... *A47L 11/4041* (2013.01); *A46B 13/001* (2013.01); *A46B 13/02* (2013.01);
(Continued)

(58) Field of Classification Search
CPC .. A47L 11/4011; A47L 9/0477; A47L 11/282; A47L 11/4041; A47L 11/4069;
(Continued)

(56) References Cited

U.S. PATENT DOCUMENTS

2018/0338654 A1* 11/2018 Kelsey ..... A47L 9/0477

FOREIGN PATENT DOCUMENTS

CN 113729552 A * 12/2012 ..... A47L 9/04
CN 105982615 A 10/2016
(Continued)

OTHER PUBLICATIONS

International Search Report and Written Opinion issued in corresponding PCT Application No. PCT/CN2023/136768, dated Jul. 8, 2024.

(Continued)

*Primary Examiner* — Laura C Guidotti
(74) *Attorney, Agent, or Firm* — Westbridge IP LLC

(57) ABSTRACT

Disclosed are an anti-tangle roller brush, a roller brush mechanism, and a sweeping robot. The anti-tangle roller brush includes a roller brush hosing and a cutting assembly. The roller brush hosing is provided with a cavity and a through slot communicating with the cavity. One end of the roller brush hosing is a driving end, the driving end is connected to a driving piece, another end of the roller brush hosing is movably connected to a fixed portion, and the fixed portion is provided with a fixed shaft extending towards the cavity. The cutting assembly includes a connecting piece and a blade provided in the cavity. The blade is provided in the through slot and is movably connected to the roller brush
(Continued)

hosing, and the connecting piece is movably connected to the fixed shaft and is connected to the blade.

9 Claims, 3 Drawing Sheets

(51) Int. Cl.
*A46B 13/02* (2006.01)
*A46B 15/00* (2006.01)
*A47L 11/24* (2006.01)

(52) U.S. Cl.
CPC ..... *A46B 15/0065* (2013.01); *A47L 11/24* (2013.01); *A47L 11/4069* (2013.01)

(58) Field of Classification Search
CPC ..... A47L 11/24; A46B 13/02; A46B 13/001; A46B 15/0065
See application file for complete search history.

(56) References Cited

FOREIGN PATENT DOCUMENTS

| | | | |
|---|---|---|---|
| CN | 110584541 | A | 12/2019 |
| CN | 110897551 | A | 3/2020 |
| CN | 111329392 | A | 6/2020 |
| CN | 211559926 | U | 9/2020 |
| CN | 112657872 | A | 4/2021 |
| CN | 112674642 | A | 4/2021 |
| CN | 113116217 | A | 7/2021 |
| CN | 113827138 | A | 12/2021 |
| CN | 114431772 | A | 5/2022 |
| CN | 112674642 | B | 9/2022 |
| CN | 217696437 | U | 11/2022 |
| CN | 218009535 | U | 12/2022 |
| CN | 221205286 | U | 6/2024 |
| JP | 2020521545 | A | 7/2020 |
| KR | 20190019534 | A | 2/2019 |
| WO | 2023025042 | A1 | 3/2023 |
| WO | 2023066254 | A1 | 4/2023 |

OTHER PUBLICATIONS

First Office Action issued in counterpart Chinese Patent Application No. 202311391852.3, dated Aug. 28, 2025.
Notification to Grant Patent Right for Invention issued in counterpart Chinese Patent Application No. 202311391852.3, dated Sep. 22, 2025.
European Search Report issued in counterpart European Patent Application No. EP 23934295.9, dated Feb. 11, 2026.
Notice of Reasons for Refusal issued in counterpart Japanese Patent Application No. 2024-564973, dated Dec. 23, 2025.

* cited by examiner

ANTI-TANGLE ROLLER BRUSH, ROLLER BRUSH MECHANISM AND SWEEPING ROBOT

CROSS-REFERENCE TO RELATED APPLICATIONS

This application is a continuation application of International Application No. PCT/CN2023/136768, filed on Dec. 6, 2023, which claims priority to Chinese Patent Application No. 202311391852.3, filed on Oct. 24, 2023, the entire contents of which are incorporated herein by reference.

TECHNICAL FIELD

The present application relates to the technical field of sweeping robots, and in particular to an anti-tangle roller brush, a roller brush mechanism and a sweeping robot.

BACKGROUND

As people's hygiene requirements for the living environment gradually increase, there are more and more cleaning equipment, such as vacuum cleaners, sweeping robots, and mopping machines. The conventional cleaning equipment is generally provided with a roller brush structure to clean the surface to be cleaned. However, during the cleaning process, the problem of hair and other debris entangled in the roller brush has been troubled by users and manufacturers. The cleaning effect of the cleaning equipment will be affected due to the debris entangled in the roller brush, and the roller brush becomes entangled more tightly with debris during the rotation process, which may easily cause the roller brush to have a large rotation resistance or may even cause the roller brush to get stuck, thus the cleaning effect of the sweeping robot is affected.

SUMMARY

The main purpose of the present application is to provide an anti-tangle roller brush, a roller brush mechanism and a sweeping robot, aiming to prevent the roller brush from being entangled with hair during the cleaning process and avoid affecting the cleaning effect.

In view of the above objectives, the present application provides an anti-tangle roller brush including:

- a roller brush housing provided with a cavity and a through slot communicating with the cavity, one end of the roller brush housing being a driving end, the driving end being connected to a driver, another end of the roller brush housing being movably connected to a fixed portion, and the fixed portion being provided with a fixed shaft extending towards the cavity; and
- a cutting assembly including a connector and a blade provided in the cavity, the blade being provided in the through slot and being movably connected to the roller brush housing, and the connector being movably connected to the fixed shaft and being connected to the blade.

The driving end is configured to drive the roller brush housing to rotate to drive the blade and the connector to rotate, so that the connector moves along the fixed shaft to drive the blade to move along an axial direction of the fixed shaft relative to the roller brush housing, so as to cut hair entangled in the roller brush housing.

In an embodiment, a fixed rod is provided in the roller brush housing, an arc-shaped slot is provided at the blade, and the fixed rod passes through and is provided in the arc-shaped slot.

In an embodiment, sawteeth are provided outside the roller brush housing, the sawteeth are evenly distributed at both sides of the through slot along the axial direction, and one end of the sawteeth away from the through slot is arranged in a rounded shape.

In an embodiment, the roller brush housing includes an upper housing and a lower housing, the upper housing is provided with a connecting column, the lower housing is provided with a connecting hole, the connecting column is inserted in the connecting hole to enable the upper housing and the lower housing to enclose and form the cavity and the through slot, the blade is provided with an avoidance slot, the connecting column is provided in the avoidance slot, and the avoidance slot is shaped in an arc.

In an embodiment, a connecting block is provided outside the connector, the blade is provided with a notch, and at least part of the connecting block is limited in the notch to enable the connector to move along the fixed shaft and drive the blade to move along the axial direction of the fixed shaft.

In an embodiment, the connector is provided with a through hole, a closed spiral slot is formed around the through hole, the fixed shaft is provided with a protruding block, the fixed shaft passes through and is provided in the through hole, and the protruding block is limited in the closed spiral slot.

In an embodiment, the connector is provided with a sliding block, the roller brush housing is provided with a sliding slot, the sliding slot is provided in the cavity, and the sliding block is limited in the sliding slot.

In an embodiment, the fixed portion includes a fixed block and the fixed shaft, the fixed block is detachably connected to the fixed shaft, and the roller brush housing is provided with an opening and a bearing cavity communicating with the cavity, a bearing is provided in the bearing cavity, the fixed shaft passes through the opening and the bearing and is connected to the connector.

The present application further provides a roller brush mechanism including an installation housing and the anti-tangle roller brush as mentioned above. The installation housing is enclosed to form an installation cavity, a driver is connected to the installation housing, the anti-tangle roller brush is provided in the installation cavity, the fixed portion is connected to the installation housing, and the driving end is connected to an output end of the driver.

The present application further provides a sweeping robot including the roller brush mechanism as mentioned above.

In the technical solution of the present application, the driving end of the roller brush housing is connected to the driver, and the driver drives the roller brush housing to rotate, thereby achieving the cleaning effect. The roller brush housing is provided with a cavity and a through slot. The fixed shaft of the fixed portion extends into the cavity and is movably connected to the connector. The connector is limited in the cavity of the roller brush housing. In addition, the driver is connected to the blade. When the driver drives the roller brush housing to rotate, the fixed shaft will not move, and the connector will rotate along with the roller brush housing. In this case, the connector rotates relative to the fixed shaft, and the fixed shaft pushes the connector to move along the axial direction of the fixed shaft. The blade of the cutting assembly is provided in the through slot. When the roller brush housing rotates, the blade rotates along with the roller brush housing. When the connector moves along the axial direction of the fixed shaft, the blade connected to the connector is driven to move along the through slot, so as to cut the hair entangled in the roller brush housing, which can avoid affecting the cleaning effect of the roller brush.

BRIEF DESCRIPTION OF THE DRAWINGS

To illustrate the technical solutions according to embodiments of the present application or the related art more clearly, the accompanying drawings for describing the embodiments or the related art are introduced briefly in the following. Apparently, the accompanying drawings in the following description are only some embodiments of the present application. Those skilled in the art can derive other drawings from the structures of the accompanying drawings without creative efforts.

Figure 1:
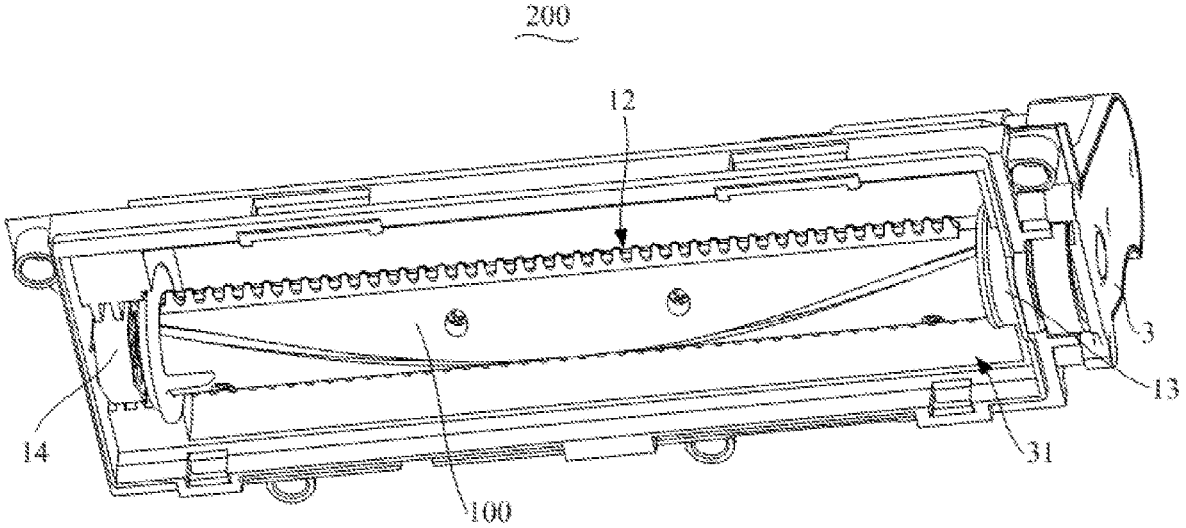
FIG. 1 is a schematic structural view of a roller brush mechanism according to an embodiment of the present application.

The realization of the objective, functional characteristics, and advantages of the present application are further described with reference to the accompanying drawings.

DETAILED DESCRIPTION OF THE EMBODIMENTS

The technical solutions of the embodiments of the present application will be described in detail below with reference to the accompanying drawings. It is obvious that the embodiments to be described are only some rather than all of the embodiments of the present application. All other embodiments obtained by persons skilled in the art based on the embodiments of the present application without creative efforts shall fall within the scope of the present application.

It should be noted that all the directional indications (such as up, down, left, right, front, back . . . ) in the embodiments of the present application are only used to explain the relative positional relationship, movement, or the like of the components in a certain posture (as shown in the accompanying drawings). If the specific posture changes, the directional indication will change accordingly.

In the present application, unless otherwise clearly specified and limited, the terms "connected", "fixed", etc. should be interpreted broadly. For example, "fixed" can be a fixed connection, a detachable connection, or a whole; can be a mechanical connection or an electrical connection; may be directly connected, or indirectly connected through an intermediate medium, and may be the internal communication between two elements or the interaction relationship between two elements, unless specifically defined otherwise. For those of ordinary skill in the art, the specific meaning of the above-mentioned terms in the present application can be understood according to specific circumstances.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Moreover, the meaning of "and/or" appearing in the entire text includes three parallel schemes. Taking "A and/or B" as an example, it includes scheme A, or scheme B, or a scheme that satisfies both A and B at the same time. In addition, the technical solutions of the various embodiments can be combined with each other, but the combinations must be based on the realization of those skilled in the art. When the combination of technical solutions is contradictory or cannot be achieved, it should be considered that such a combination of technical solutions does not exist, nor does it fall within the scope of the present disclosure.

As shown in FIG. 1 to FIG. 5, the present application provides an anti-tangle roller brush 100. The anti-tangle roller brush 100 includes a roller brush housing 1 and a cutting assembly 2. The roller brush housing 1 is provided with a cavity 11 and a through slot 12 communicating with the cavity 11. One end of the roller brush housing 1 is a driving end 13, and the driving end 13 is connected to a driver. Another end of the roller brush housing 1 is movably connected to a fixed portion 14, and the fixed portion 14 is provided with a fixed shaft 141 extending towards the cavity 11. The cutting assembly 2 includes a connector 21 and a blade 22 provided in the cavity 11. The blade 22 is provided in the through slot 12 and is movably connected to the roller brush housing 1. The connector 21 is movably connected to the fixed shaft 141 and is connected to the blade 22. The driving end 13 drives the roller brush housing 1 to rotate to drive the blade 22 and the connector 21 to rotate, so that the connector 21 moves along the fixed shaft 141 to drive the blade 22 to move along an axial direction of the fixed shaft 141 relative to the roller brush housing 1, so as to cut hair entangled in the roller brush housing 1.

Figure 2:
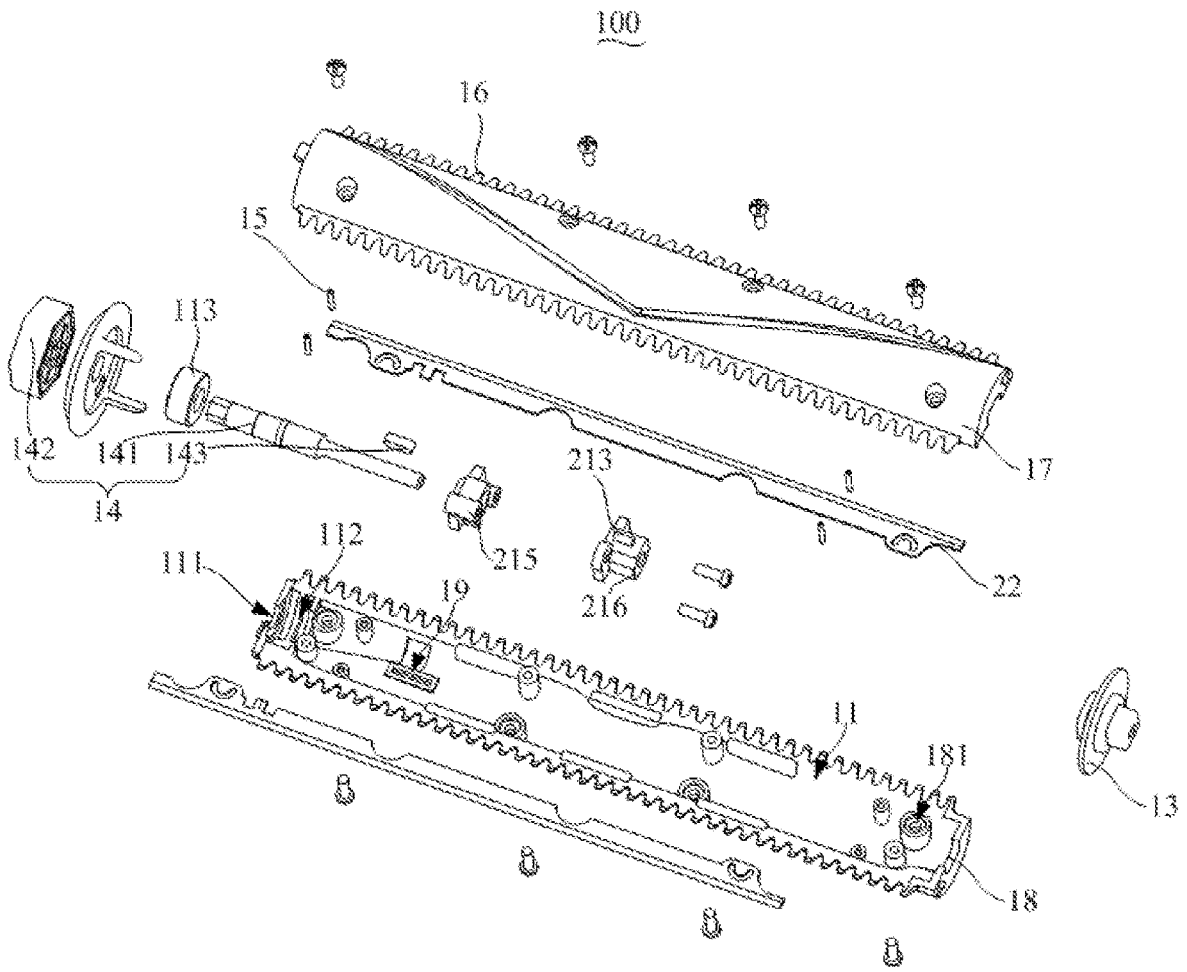
FIG. 2 is an exploded schematic view of the roller brush mechanism according to an embodiment of the present application.
Figure 3:
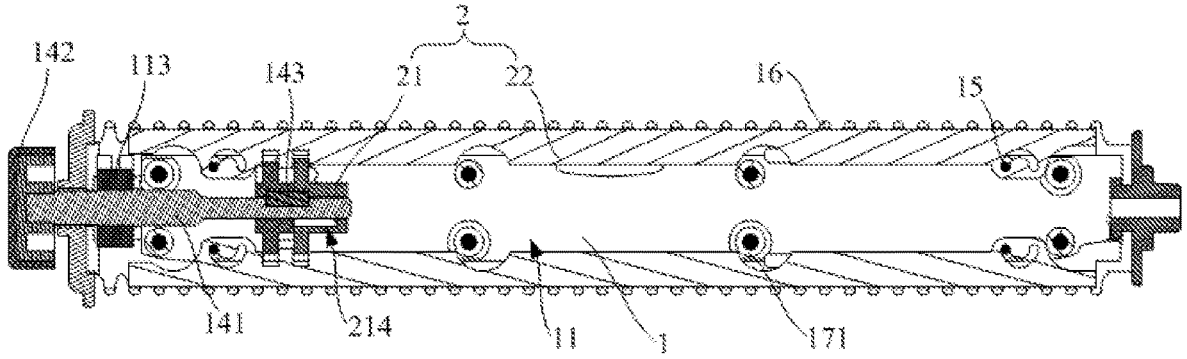
FIG. 3 is a cross-sectional schematic view of the roller brush mechanism according to an embodiment of the present application.

In this embodiment, as shown in FIG. 1 to FIG. 3, the anti-tangle roller brush 100 is composed of a roller brush housing 1 and a cutting assembly 2. The rubber is installed outside the roller brush housing 1. One end of the roller brush housing 1 is the driving end 13, and the other end of the roller brush housing 1 is movably connected to the fixed portion 14. The driving end 13 may be connected to the output end of the driver. The driver can drive the roller brush housing 1 to rotate, so as to roll up the debris and facilitate collecting the debris to the debris box, thereby achieving the cleaning effect. The roller brush housing 1 is provided with a cavity 11 and a through slot 12. The fixed portion 14 is provided with a fixed shaft 141. The fixed shaft 141 extends into the cavity 11 of the roller brush housing 1. The connector 21 of the cutting assembly 2 is movably connected to the fixed shaft 141. In addition, the connector 21 is also connected to the blade 22. When the driver drives the roller brush housing 1 to rotate, the fixed shaft 141 of the fixed portion 14 will not move, and the connector 21 will rotate along with the roller brush housing 1. In this case, the connector 21 rotates relative to the fixed shaft 141, and the fixed shaft 141 pushes the connector 21 to move along the axial direction of the fixed shaft 141. The blade 22 of the cutting assembly 2 is provided in the through slot 12. When the roller brush housing 1 rotates, the blade 22 rotates along with the roller brush housing 1. When the connector 21 moves along the axial direction of the fixed shaft 141, the connector 21 drives the blade 22 to move along the axial direction, so as to cut the hair entangled in the roller brush housing 1, which can not only prevents the hair from continuing to be entangled in the brush housing 1, but also can avoid affecting the rotation of the roller brush housing 1 and the cleaning effect of the roller brush. In this embodiment, the cooperation of the fixed shaft 141 and the connector 21 not only enables the driver to drive the roller brush housing 1 to rotate, but also allows the blade 22 to move along the axial direction. In this way, there is no need to additionally provide a driver for the blade 22, thereby avoiding providing redundant and complicated structures and improving the stability of the cutting assembly 2.

In actual implementation, an installation slot for the rubber to be installed is formed outside the roller brush housing 1, so that the rubber can be detachably installed at the roller brush housing 1, which facilitates the replacement of the rubber. When the blade 22 is provided in the through slot 12, at least part of the blade 22 extends out of the through slot 12, so that the blade 22 can cut the hair entangled in the brush housing 1 when moving along the axial direction. A protective structure can be provided at the side of the through slot 12 facing the outside, to prevent the blade 22 from hurting people.

Figure 5:
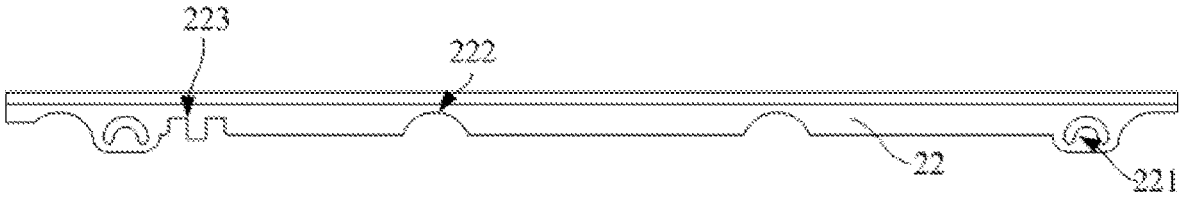
FIG. 5 is a schematic structural view of a blade according to an embodiment of the present application.

In an embodiment, as shown in FIG. 2, FIG. 3 and FIG. 5, the roller brush housing 1 is provided with a fixed rod 15. An arc-shaped slot 221 is provided at the blade 22, and the fixed rod 15 passes through and is provided in the arc-shaped slot 221.

In this embodiment, the fixed rod 15 is provided in the cavity 11, and the fixed rod 15 passes through and is provided in the arc-shaped slot 221 of the blade 22, so that the blade 22 is movably connected to the roller brush housing 1, and the blade 22 can rotate along with the roller brush housing 1. When the blade 22 is driven by the connector 21 to move along the axial direction of the fixed shaft 141, the blade 22 is abutted against by the fixed rod 15, so that the blade 22 will move along an arc-shaped trajectory. That is, with the blade 22 as a reference, the fixed rod 15 moves in the arc-shaped slot 221 relative to the blade 22. In this way, not only the fixed rod 15 pushes the blade 22 to move along the axial direction, but also the blade 22 can telescopically move in the through slot 12 along the direction perpendicular to the axial direction, thereby better cutting the hairs entangled in the roller brush housing 1. In addition, the arc-shaped slot 221 has a rounded transition, and the movement resistance of the fixed rod 15 relative to the arc-shaped slot 221 is small, making the movement of the fixed rod 15 relative to the arc-shaped slot 221 more smoothly, and the blade 22 will not get stuck during movement.

In actual implementation, the radian and the arc length of the arc-shaped slot 221 can be adjusted according to the actual cutting effect of the blade 22. The greater the arc of the arc-shaped slot 221, the longer the stroke of the blade 22 in the through slot 12. The longer the arc length of the arc-shaped slot 221, the smaller the radian, and the longer the stroke of the blade 22 moving along the axial direction of the fixed shaft 141.

In an embodiment, as shown in FIG. 1 to FIG. 3, the sawteeth 16 are provided outside the roller brush housing 1. The sawteeth 16 are evenly distributed at both sides of the through slot 12 along the axial direction, and one end of the sawteeth 16 away from the through slot 12 is arranged in a rounded shape.

In this embodiment, the sawteeth 16 are distributed outside the roller brush housing 1 along the axial direction, and a depression is formed between the sawteeth 16. When the hair is entangled in the roller brush housing 1, as the roller brush housing 1 rotates, hair will get entangled in the depression. When the blade 22 moves in the through slot 12, the movement range of the outer portion of the blade 22 may fall within the gap between the end of the depression close to the through slot 12 and the end of the sawtooth 16 away from the through slot 12. In this way, the blade 22 can cut the hair entangled in the depression without protruding from the sawteeth 16, thereby avoiding hurting people. The end of the sawtooth 16 away from the through slot 12 is arranged in a round shape, so that the hair entangled in the roller brush housing 1 will more easily drop into the depression, thereby improving the efficiency of the cutting assembly 2 cutting hair.

In actual implementation, the sawteeth 16 are evenly and spacedly arranged at both sides of the through slot 12, and the spacing between the sawteeth 16 can range from 0.1 cm to 0.5 cm, which is not limited here.

In an embodiment, as shown in FIG. 2, FIG. 3 and FIG. 5, the roller brush housing 1 includes an upper housing 17 and a lower housing 18. The upper housing 17 is provided with a connecting column 171, and the lower housing 18 is provided with a connecting hole 181. The connecting column 171 is inserted into the connecting hole 181, so that the cavity 11 and the through slot 12 can be formed by an enclosure of the upper housing 17 and the lower housing 18. The blade 22 is provided with an avoidance slot 222, and the avoidance slot 222 is shaped in an arc.

In this embodiment, the roller brush housing 1 is composed of an upper housing 17 and a lower housing 18. The upper housing 17 is detachably connected to the lower housing 18 through the connecting column 171 and the connecting hole 181. The upper housing 17 and the lower housing 18 are enclosed to form the cavity 11. The connecting column 171 is inserted into the connecting hole 181, so that when the upper housing 17 is connected to and the lower housing 18, a certain distance is maintained between the upper housing 17 and the lower housing 18 to form a through slot 12. Corresponding to the connecting column 171, the avoidance slot 222 is provided in the through slot 12 for the avoidance of the blade 22. The avoidance slot 222 is shaped in an arc, thereby reducing the resistance of the connecting column 171 to the blade 22 when the blade 22 moves relative to the connecting column 171. In addition, the connecting column 171 can share the pressure on the fixed rod 15 when the blade 22 moves, thereby improving the stability of the blade 22 when the blade 22 moves in an arc-shaped trajectory.

In actual implementation, a threaded hole can be provided in the connecting column 171, so that the connecting column 171 can be connected to the connecting hole 181 by screws. The distance between the upper housing 17 and the lower housing 18 should be greater than the thickness of the blade 22, so that the blade 22 can move in the through slot 12. In this way, when the blade 22 moves in the through slot 12, the blade 22 can be prevented from getting stuck and affecting the cutting effect of the blade 22.

In an embodiment, as shown in FIG. 2 to FIG. 5, a connecting block 211 is provided outside the connector 21, and a notch 223 is provided at the blade 22. At least part of the connecting block 211 is limited to the notch 223, so that the connector 21 can move along the fixed shaft 141, driving the blade 22 to move along the axial direction of the fixed shaft 141.

In this embodiment, a connecting block 211 is provided outside the connector 21. The connecting block 211 matches with the notch 223 of the blade 22, so that the connecting block 211 can drive the blade 22 to move along the axial direction, and the blade 22 can cut the entangled hair. In the direction perpendicular to the axial direction, the stroke of the connecting block 211 in the notch 223 should be greater than the telescopic stroke of the blade 22 in the through slot 12, which can not only prevent the connecting block 211 from separating from the notch 223 when the blade 22 moves, but also can avoid affecting the normal operation of cutting assembly 2.

In actual implementation, the connecting block 211 can be integral with the connector 21. The cross-sectional shape and the size of the connecting block 211 are the same as that of the notch 223. The blade 22 includes a fixed portion 14 and a cutting portion. The fixed portion 14 has a uniform thickness and is provided with the notch 223 for limiting the position of the connecting block 211 and the arc-shaped slot 221 for the fixing rod 15 to pass through, thereby ensuring the strength of the blade 22. The cross-sectional area of the cutting portion gradually decreases from the end close to the cavity 11 to the outside of the through slot 12, to cut the entangled hair.

Figure 4:
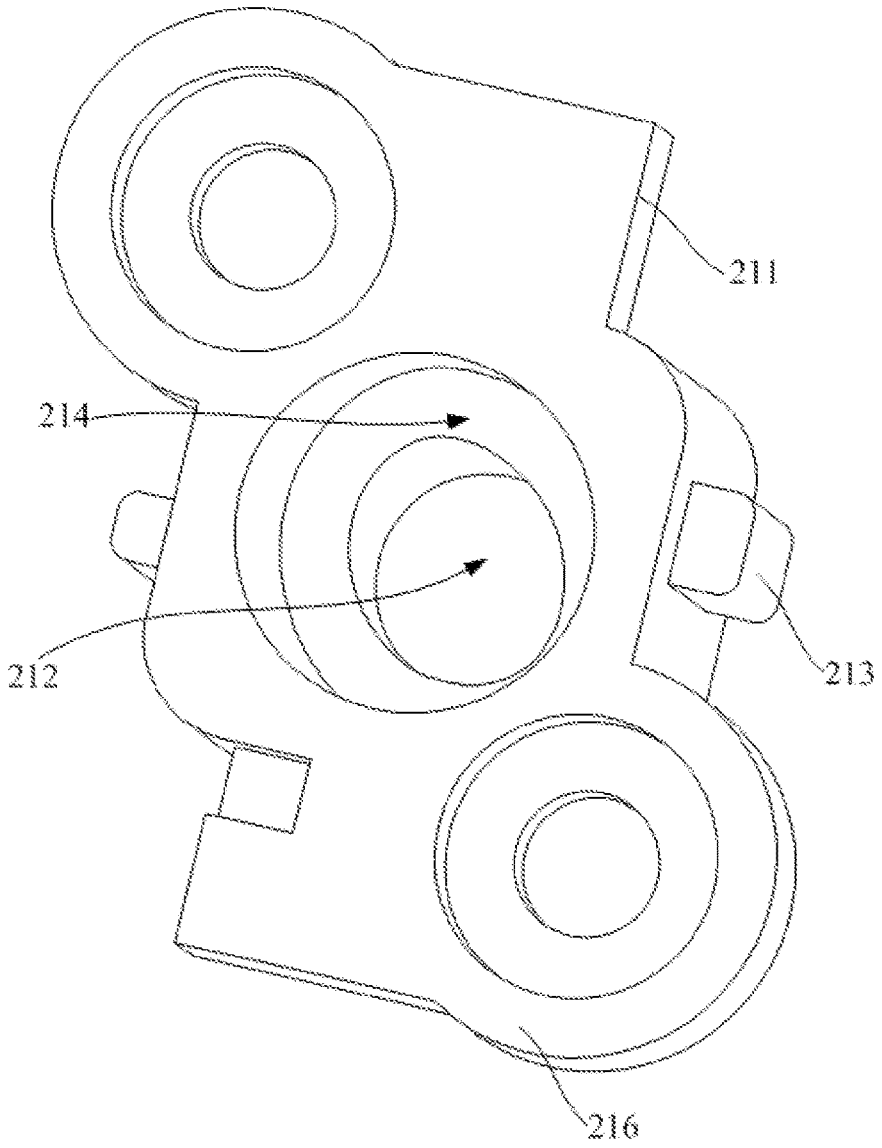
FIG. 4 is a schematic view of the split structure of a connector according to an embodiment of the present application.

In an embodiment, as shown in FIG. 2 to FIG. 4, the connector 21 is provided with a through hole 212, and a closed spiral slot 214 is formed around the through hole 212. The fixed shaft 141 is provided with a protruding block 143, and the fixed shaft 141 passes through the through hole 212. The protruding block 143 is limited in the closed spiral slot 214.

In this embodiment, the fixed shaft 141 passes through and is provided in the through hole 212 in the connector 21, so that the connector 21 can rotate around the fixed shaft 141. The fixed shaft 141 is provided with a protruding block 143, and the protruding block 143 is limited in a closed spiral slot 214. When the connector 21 rotates around the fixed shaft 141, with the connector 21 as a reference, the protruding block 143 moves in the closed spiral slot 214. In addition, the movement trajectory of the protruding block 143 relative to the connector 21 in the closed spiral slot 214 is the actual movement trajectory of the connector 21. Through the arrangement of the closed spiral slot 214, the rotation of the connector 21 is converted into a reciprocating movement along the axial direction of the fixed shaft 141, thereby driving the blade 22 to move back and forth along the axial direction in the through slot 12 to cut the tangled hair.

In actual implementation, the connector 21 is composed of a first block 215 and a second block 216 to facilitate the installation and production of the connector 21. The first block 215 is detachably connected to the second block 216 to enclose and form a close the spiral slot 214. The first block 215 can be detachably connected to the second block 216 through bolts or buckles. A fixed slot can be provided at the fixed shaft 141, and the protruding block 143 is limited in the fixed slot, so that when the connector 21 rotates, the protruding block 143 will not move. The first block 215 and the second block 216 can be arranged symmetrically.

In actual implementation, the closed spiral slot 214 is provided with a first surface and a second surface opposite and parallel to each other. The protruding block 143 is limited between the first surface and the second surface. The first surface and the second surface are both shaped in the smooth round to reduce the resistance when the protruding block 143 moves relative to the closed spiral slot 214. Both the first surface and the second surface are provided with a high portion and a low portion with a distance difference along the axial direction of the fixed shaft 141. With the connector 21 as a reference, when the protruding block 143 moves from the high portion to the low portion, the blade 22 moves close to the connector 21, and when the protruding block 143 moves from the low portion to the high portion, the blade 22 moves away from the connector 21. In the connector 21, there may be a plurality of high portions and lower portions distributed at intervals, which can increase the frequency of reciprocation movement of the blade 22 along the fixed shaft 141.

In another embodiment, the protruding block 143 can be provided at the connector 21 and provided in the through hole 212. The closed spiral slot 214 can be provided at the fixed shaft 141, and the protruding block 143 is limited in the closed spiral slot 214, which can also convert the rotation of the connector 21 into the axial movement along the fixed shaft 141.

In an embodiment, as shown in FIG. 2 to FIG. 4, the connector 21 is provided with a sliding block 213, and the roller brush housing 1 is provided with a sliding slot 19. The sliding slot 19 is provided in the cavity 11, and the sliding block 213 is limited in the sliding slot 19.

In this embodiment, a sliding block 213 is provided outside the connector 21, and the sliding block 213 is limited in the sliding slot 19 of the brush housing 1, so that when the brush housing 1 rotates, the connector 21 can rotate along with the brush housing 1. The sliding slot 19 extends along the axial direction of the fixed shaft 141, so that the connector 21 can slide along the axial direction of the fixed shaft 141. The length of the sliding slot 19 can be set according to the stroke of the connector 21 in the axial direction. The side wall of the sliding slot 19 can be provided with a limiting slot, and correspondingly, the sliding block 213 can be provided with a limiting protrusion, so that the sliding block 213 can be better limited in the sliding slot 19 and can slide in the sliding slot 19.

In actual implementation, the connector 21 can be provided with a sliding slot 19, and correspondingly, the roller brush housing 1 is provided with a sliding block 213. The sliding block 213 can be limited in the sliding slot 19.

In an embodiment, as shown in FIG. 2 and FIG. 3, the fixed portion 14 includes a fixed block 142 and a fixed shaft 141. The fixed block 142 is detachably connected to the fixed shaft 141. The roller brush housing 1 is provided with an opening 111 and a bearing cavity 112 communicating with the cavity 11. The fixed shaft 141 passes through the opening 111 and the bearing cavity 112. The bearing 113 is provided in the bearing cavity 112 and is connected to the connector 21.

In this embodiment, the fixed portion 14 is connected to the roller brush housing 1 through the bearing 113, so that the roller brush housing 1 can rotate relative to the fixed portion 14. The fixed portion 14 is composed of a fixed block 142 and a fixed shaft 141. The fixed block 142 is used to limit and fix the fixed shaft 141. The bearing 113 is limited in the bearing cavity 112 formed by an enclosure of the roller brush housing 1. The fixed shaft 141 extends into the cavity 11 through the opening 111 of the roller brush housing 1, then passes through the bearing 113 and is connected to the connector 21.

In actual implementation, the cross-sectional shape of the fixed block 142 may be a triangle or a polygon, so as to facilitate the installation of a correspondingly shaped fixed slot. In this way, when the fixed block 142 is limited in the fixed slot, the fixed block 142 will not rotate along with the roller brush housing 1. The fixed block 142 can be detachably connected to the fixed shaft 141 through bolts or a snap structure, which is not limited here.

As shown in FIG. 1, the present application also provides a roller brush mechanism 200. The roller brush mechanism 200 includes an installation housing 3 and an anti-tangle roller brush 100. The specific structure of the anti-tangle roller brush 100 may refer to the above embodiments. Since the brush mechanism 200 adopts all the technical solutions of the above embodiments, it has at least all the beneficial effects brought by the technical solutions of the above embodiments, which will not be repeated here.

In this embodiment, an installation cavity 31 is formed by an enclosure of the installation housing 3, and the installation cavity 31 is connected to a driver. The anti-tangle roller brush 100 is provided in the installation cavity 31, and the fixed portion 14 is connected to the installation housing 3. The driving end 13 is connected to the output end of the driver.

In actual implementation, a driving installation cavity 31 is formed at one end of the installation housing 3. The driving installation cavity 31 communicates with the installation cavity. The driver is detachably installed in the driving installation cavity 31 and is connected to the driving end 13. The fixed portion 14 of the anti-tangle roller brush 100 is connected to the other end of the installation cavity 31, so that when the driver drives the anti-tangle roller brush 100 to rotate, the fixed portion 14 will not move.

The present application further provides a sweeping robot. The sweeping robot is provided with a roller brush mechanism 200. The specific structure of the roller brush mechanism 200 may refer to the above-mentioned embodiments. Since the sweeping robot adopts all the technical solutions of the above-mentioned embodiments, it has at least all the beneficial effects brought by the technical solutions of the above-mentioned embodiments, which will not be repeated here.

The above are only some embodiments of the present application, and do not limit the scope of the present application thereto. Under the concept of this application, any equivalent structural transformation made according to the description and drawings of the present application, or direct/indirect application in other related technical fields shall fall within the claimed scope of the present application.

What is claimed is:

1. An anti-tangle roller brush, comprising:

a roller brush housing provided with a cavity and a through slot communicating with the cavity, wherein one end of the roller brush housing is a driving end, the driving end is connected to a driver, another end of the roller brush housing is movably connected to a fixed portion, and the fixed portion is provided with a fixed shaft extending towards the cavity; and a cutting assembly comprising a connector and a blade provided in the cavity, wherein the blade is provided in the through slot and is movably connected to the roller brush housing, and the connector is movably connected to the fixed shaft and is connected to the blade, and the driving end is configured to drive the roller brush housing to rotate to drive the blade and the connector to rotate, so that the connector moves along the fixed shaft to drive the blade to move along an axial direction of the fixed shaft relative to the roller brush housing, so as to cut hair entangled in the roller brush housing;

wherein a fixed rod is provided in the roller brush housing, an arc-shaped slot is provided at the blade, and the fixed rod passes through and is provided in the arc-shaped slot.

2. The anti-tangle roller brush according to claim 1, wherein sawteeth are provided outside the roller brush housing, the sawteeth are evenly distributed at both sides of the through slot along the axial direction, and one end of the sawteeth away from the through slot is arranged in a rounded shape.

3. The anti-tangle roller brush according to claim 2, wherein the roller brush housing comprises an upper housing and a lower housing, the upper housing is provided with a connecting column, the lower housing is provided with a connecting hole, the connecting column is inserted in the connecting hole to enable the upper housing and the lower housing to enclose and form the cavity and the through slot, the blade is provided with an avoidance slot, the connecting column is provided in the avoidance slot, and the avoidance slot is shaped in an arc.

4. The anti-tangle roller brush according to claim 1, wherein a connecting block is provided outside the connector, the blade is provided with a notch, and at least part of the connecting block is limited in the notch to enable the connector to move along the fixed shaft and drive the blade to move along the axial direction of the fixed shaft.

5. The anti-tangle roller brush according to claim 1, wherein the connector is provided with a through hole, a closed spiral slot is formed around the through hole, the fixed shaft is provided with a protruding block, the fixed shaft passes through and is provided in the through hole, and the protruding block is limited in the closed spiral slot.

6. The anti-tangle roller brush according to claim 1, wherein the connector is provided with a sliding block, the roller brush housing is provided with a sliding slot, the sliding slot is provided in the cavity, and the sliding block is limited in the sliding slot.

7. The anti-tangle roller brush according to claim 1, wherein the fixed portion comprises a fixed block and the fixed shaft, the fixed block is detachably connected to the fixed shaft, and the roller brush housing is provided with an opening and a bearing cavity communicating with the cavity, a bearing is provided in the bearing cavity, the fixed shaft passes through the opening and the bearing and is connected to the connector.

8. A roller brush mechanism, comprising an installation housing and the anti-tangle roller brush according to claim 1, wherein the installation housing is enclosed to form an installation cavity, the driver is connected to the installation housing, the anti-tangle roller brush is provided in the installation cavity, the fixed portion is connected to the installation housing, and the driving end is connected to an output end of the driver.

9. A sweeping robot, comprising the roller brush mechanism according to claim 8.

* * * * *